US005437392A

United States Patent [19]

Carboni

[11] Patent Number: 5,437,392

[45] Date of Patent: Aug. 1, 1995

[54] DISPENSING DEVICE IN AUTOMATIC DISTRIBUTORS FOR PRODUCTS PACKED IN BOXES

[75] Inventor: Giancarlo Carboni, Parma, Italy

[73] Assignee: S.A.I.A. S.p.A., Parma, Italy

[21] Appl. No.: 246,681

[22] Filed: May 20, 1994

[30] Foreign Application Priority Data

May 24, 1993 [IT] Italy ..... PR93A0023

[51] Int. Cl.[6] ..... B65H 3/16

[52] U.S. Cl. ..... 221/212; 221/268

[58] Field of Search ..... 221/212, 268

[56] References Cited

U.S. PATENT DOCUMENTS 531,384 12/1894 Olson ..... 221/212

FOREIGN PATENT DOCUMENTS 1181622 7/1989 Japan ..... 221/212 X

*Primary Examiner*—William E. Terrell
*Assistant Examiner*—Dean A. Reichard
*Attorney, Agent, or Firm*—Darby & Darby

[57] ABSTRACT

The dispensing device incorporates an electromagnet, an electronic card and an impulse counter, all supplied by a single multicore cable.

2 Claims, 1 Drawing Sheet

DISPENSING DEVICE IN AUTOMATIC DISTRIBUTORS FOR PRODUCTS PACKED IN BOXES

BACKGROUND OF THE INVENTION

Known-type automatic distributors of boxed products comprise a plurality of vertical channels formed by lateral walls which are modularly adaptable to the dimensions of the boxes being packed. The channels are inferiorly closed by a channel led plane on which the box-dispensing device runs.

Italian patent no. 1233973 describes such an automatic distributor wherein each of the box dispensing devices comprises an angled bar bearing a metal plate positioned such as to be axial to an electromagnet supported on an alternating longitudinal bar.

The principal aim of the present invention is to improve the dispensing devices from both a technical and a functional point of view.

SUMMARY OF THE INVENTION

In particular, the dispensing device of the invention has the advantage of incorporating an electromagnet and an electronic card which on receiving a signal from a counter element powers up the electromagnet.

Electrical components are not installed on the fixed part of the machine: instead, they are housed on the dispensing device itself, so that when some fault occurs, it is sufficient simply to substitute the device.

The aims and advantages will better emerge from the following description of the angle bar for automatic distributors for boxed products of the invention, which characterized as in the accompanying claims.

BRIEF DESCRIPTION OF THE DRAWINGS

Further characteristics and advantages of the present invention will better emerge from the detailed description that follows, of a preferred but non-exclusive embodiment here illustrated in the form of a non-limiting example in the accompanying drawings, in which.

DESCRIPTION OF THE PREFERRED EMBODIMENTS

With reference to the figures, 1 denotes the entire dispensing device, which comprises a base plate 2 bearing at an end a vertical wall 3.

Figure 1:
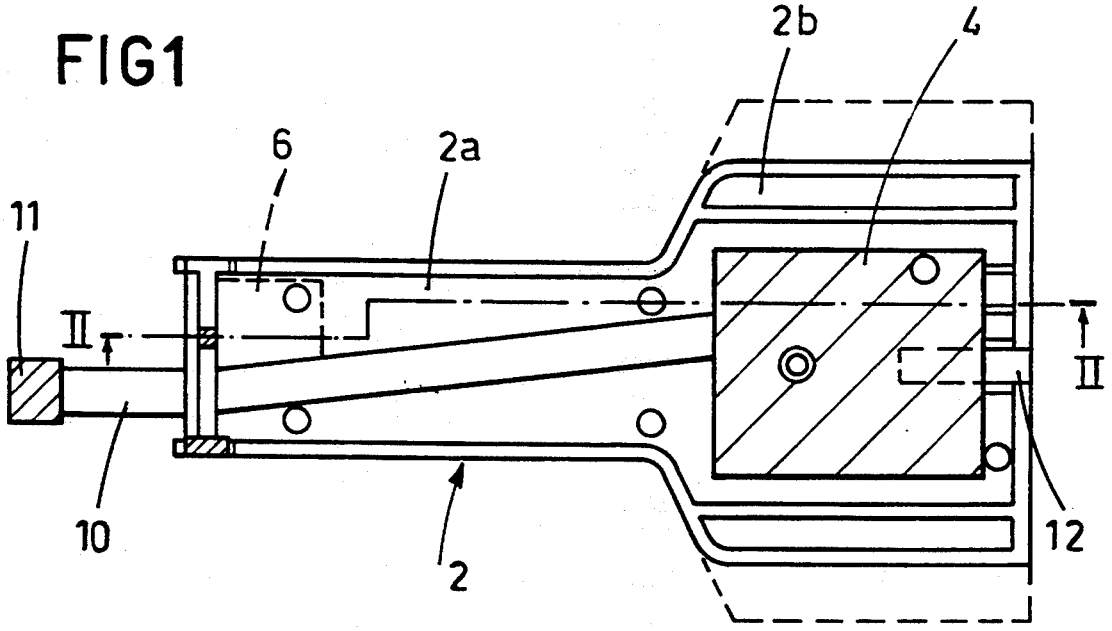
FIG. 1 shows the dispensing device in a plan view from above.
Figure 2:
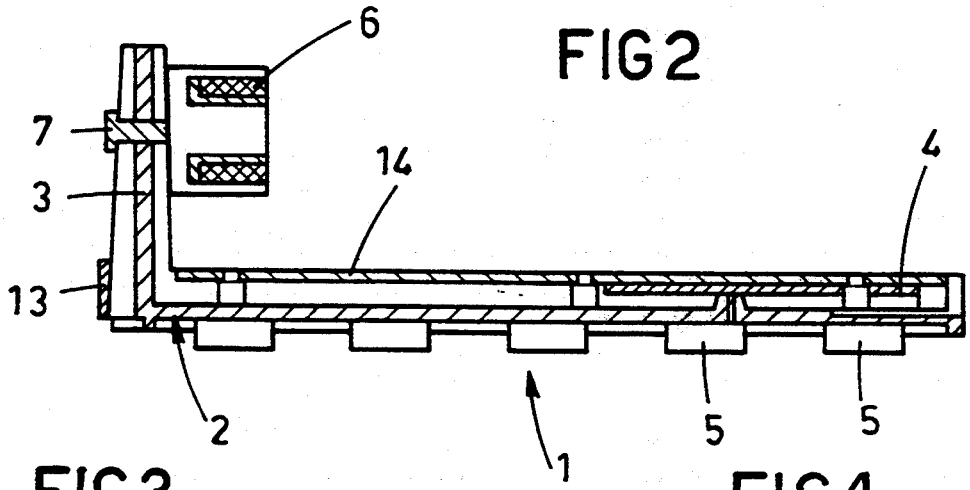
FIG. 2 shows the dispensing device in a lateral view, sectioned according to line II—II of FIG. 1.
Figure 3:
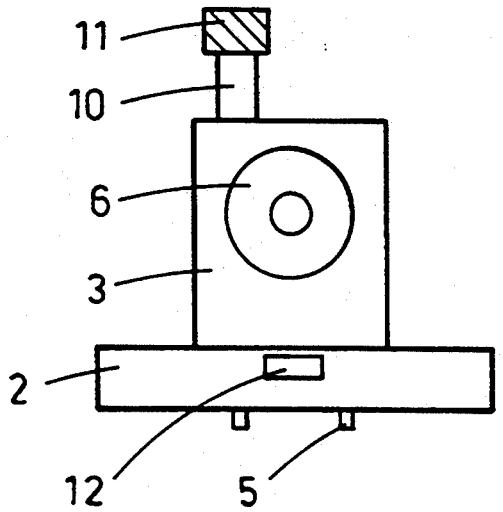
FIG. 3 is a frontal view of the dispensing device.
Figure 4:
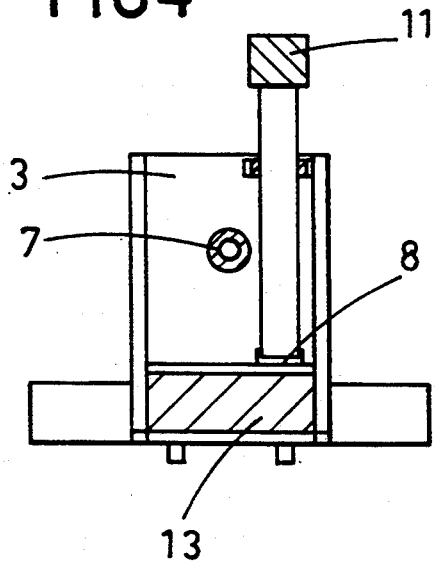
FIG. 4 is a posterior view of the dispensing device.

The base plate 2 comprises a first zone 2*a* and a second zone 2*b*, which is broader than said first zone 2*a* and which houses an electronic card 4. As illustrated with a broken line in FIG. 1, the second zone 2*b* is able to vary its breadth in accordance with a size of a box to be dispensed.

The base plate 2 exhibits projections 5 which slide in special channels (not illustrated). An electromagnet 6 is housed on the vertical wall 3, and constrained to said wall 3 by screws 7. A slot 8 is made in the vertical wall for passage of a multicore cable 10 provided with a crimp 11, which cable 10 supplies the card 4.

The card receives impulses from an impulse counter 12 and supplies current to the electromagnet 6. The impulse counter 12 can be either mechanical or photoelectric, or a proximity sensor.

A permanent magnet 13 is provided at a lower part of the vertical wall 3 and obviates an unwanted dispensing device operation caused by residual magnetization in the electromagnet 8.

The electronic card is superiorly protected by a cover 14 which superiorly closes all of the base plate 2. The dispensing device of the invention, has the advantage of including one only multicore cable for feeding the electromagnet, the electronic card and the impulse counter, which cable is subject to deformation (and therefore stress) only during the box dispensing phase and not at all when there is not a box present in a particular channel of the automatic box distributor.

What is claimed:

1. A dispensing device in automatic distributors of boxed products, comprising:

a base plate exhibiting a vertical wall;

an electromagnet fixed on the vertical wall;

an electronic card housed on the dispensing device;

a multicore cable exhibiting a crimp connector for supplying the electronic card;

an impulse counter for sending impulses to the electronic card to command the electromagnet.

2. A dispensing device as in claim 1, wherein a permanent magnet is provided on the vertical wall to neutralize residual magnetization the electromagnet.

* * * * *

UNITED STATES PATENT AND TRADEMARK OFFICE

CERTIFICATE OF CORRECTION

PATENT NO. : 5,437,392

DATED : August 1, 1995

INVENTOR(S) : Giancarlo CARBONI

It is certified that error appears in the above-indentified patent and that said Letters Patent is hereby corrected as shown below:

On the title page, item [30], Foreign Application Priority Data, change "PR93A0023" to --PR93A000023--.

Signed and Sealed this

Third Day of October, 1995

Bruce Lehman

*Attest:*

BRUCE LEHMAN

*Attesting Officer*

*Commissioner of Patents and Trademarks*